United States Patent [19]

Nakazato et al.

[11] 4,050,953

[45] Sept. 27, 1977

[54] PROCESS FOR CONTINUOUSLY PRODUCING SUGAR

[75] Inventors: Norio Nakazato; Kosai Hiratsuka; Tokinobu Furukawa, all of Kudamatsu, Japan

[73] Assignee: Hitachi, Ltd., Japan

[21] Appl. No.: 698,080

[22] Filed: June 21, 1976

[30] Foreign Application Priority Data

June 24, 1975 Japan ..... 50-76903

[51] Int. Cl.[2] ..... C13F 1/02; C13G 1/00

[52] U.S. Cl. ..... 127/60; 127/16; 127/61; 159/44; 159/47 R; 159/45

[58] Field of Search ..... 127/15, 16, 58, 60, 127/61; 159/47 R

[56] References Cited

U.S. PATENT DOCUMENTS 3,899,386 8/1975 Komiyama ..... 127/60

OTHER PUBLICATIONS

Spencer-Meade, "Cane Sugar Handbook", 9th Edition, p. 222, John Wiley & Sons, Inc., N.Y.

*Primary Examiner*—Sidney Marantz
*Attorney, Agent, or Firm*—Craig & Antonelli

[57] ABSTRACT

In a continuous sugar evaporator-crystallizer having a plurality of evaporating-crystallizing vessels as stages, each evaporating-crystallizing stages being communicated one to another in series and being provided with a means for feeding an aqueous sugar solution, a heating means and a means for withdrawing generated steam, by feeding an aqueous sugar solution to each evaporating-crystallizing stage, heating the aqueous sugar solution in each evaporating-crystallizing stage, thereby evaporating water off the aqueous sugar solution and crystallizing sugar crystals, and withdrawing the generated steam from each of the stages, while feeding seed sugar crystals to the first evaporating-crystallizing stage and withdrawing the resulting sugar crystal slurry from the last evaporating-crystallizing stage, sugar crystals of high quality is obtained in the slurry with an effective suppression of occurrence of conglomerated sugar grains by providing sugar crystal distances of 0.26 to 0.59 mm in the solution in the first evaporating-crystallizing stage, and feeding the aqueous sugar solution to each of intermediate evaporating-crystallizing stages excluding the first and last evaporating-crystallizing stages at a substantially equal feed rate, and making the feed rate of the aqueous sugar solution to the first evaporating-crystallizing stage at least 1.5 times the feed rate to each of the intermediate evaporating-crystallizing stages.

7 Claims, 4 Drawing Figures

PROCESS FOR CONTINUOUSLY PRODUCING SUGAR

The present invention relates to a process for continuously producing sugar of good quality in a continuous sugar evaporator-crystallizer, particularly in a continuous sugar evaporator-crystallizer having a plurality of evaporating-crystallizing vessels as stages, each evaporating-crystallizing stages being communicated one to another in series by feeding an aqueous sugar feed solution to each of the evaporating-crystallizing stages, evaporating water off from each stage and making sugar crystals grow in the stages.

Heretofore, crystallization of sugar has been carried out batchwise in a calandria-type evaporator-crystallizer, where an aqueous sugar feed solution is initially charged to the evaporator-crystallizer in an amount of not more than one-half of the capacity of the evaporator-crystallizer; seed sugar crystals are then added thereto; evaporation is carried out, bringing the sugar solution into a supersaturated state, and depositing sugar onto the seeds to make the crystals grow; the evaporation is continued while supplying the sugar feed solution according to an appropriate program; when the grain size of the crystals reaches a desired one, the evaporation is interrupted and the resulting crystal slurry is subjected to liquid-solid separation to recover sugar crystals from the slurry. However, the prior art batch process has disadvantages in working efficiency of crystallizer-evaporator, steam consumption, etc., and recently continuous sugar evaporator-crystallizers and continuous process based on the continuous sugar evaporator-crystallizer have been proposed to improve the disadvantages inherent to the batch process.

Continuous production of sugar is carried out by continuously feeding the seed crystals and the sugar solution to an evaporator-crystallizer, while withdrawing the solution from the evaporator-crstallizer. In the case the evaporator-crystallizer consists of a single vessel, or single stage, retention time of crystals cannot be kept uniform in the vessel, and thus a grain size distribution is liable to be larger. Thus, a system having a plurality of vessels communicated one to another in series has been proposed as the continuous sugar evaporator-crystallizer, where a sugar solution containing sugar crystals in successively led from the preceding vessel to another to make a distribution of retention time uniform in the continuous sugar evaporator-crystallizer. That is, the principle of the process for continuously producing sugar in the continuous sugar evaporator-crystallizer comprises continuously feeding seed crystals and an aqueous sugar feed solution to the first stage, and the aqueous sugar feed solution to each of other stages, thereby evaporating water and concentrating the sugar solution to a supersaturated state in each stage, successively transferring the sugar solution from one upper stage to another lower succeeding stage, while making the seed crystals to the desired grain size, and continuously withdrawing the resulting slurry from the last stage, followed by separation and drying in the successive steps.

In crystallization operation of sugar, it is the ordinary expedient to lower a crystal concentration (number of crytals in unit volume) as the grain sizes are increasing. In said prior art batch process, the sugar solution is supplied afterwards for this reason. Also in the continuous production of sugar it is necessary to feed the sugar solution to each stage, but feed the sugar solution at an increasing rate to the lower stages.

Generally it is preferable in the continuous production of sugar to transfer the sugar solution from one stage to another lower stage so as to take a piston flow and make the retention time constant. That is, the continuous production of sugar is based on a system of such type as a plurality of mixing vessels provided in stages so as to communicate one with another in series, where a distribution of retention time can be made smaller by increasing the number of stages. However, in the actual apparatus, the number of stages is restricted, and it is theoretically clarified that the minimum distribution of retention time with a given number of stages can be obtained when the retention time is equal in every stages. Thus, in the continuous production of sugar, the flow rate is increased in the latter stages. For example, the flow rate in the last stage is 3 to 10 times the flow rate in the first stage. Therefore, the volumes of the vessels as stages must be made larger in the latter stages so that the flow can take a piston flow to make the grain size distribution smaller. For example, the well known horizontal type, continuous evaporator-crystallizer is in such a structure that the volumes of the vessels are increased in the latter stages.

However, the continuous production of sugar based on the evaporator-crystallizer where the volumes of the vessels as stages are increased in the latter stages has the following disadvantages: change in the volumes of the vessels makes the structure of the apparatus complicated, resulting in an increase in the fabrication cost, and further makes the operating control of the apparatus difficult, resulting in an increased susceptibility to disturbances.

To eliminate these disadvantages and facilitate the fabrication of apparatus and the operating control of the entire apparatus under less influence of disturbances, another process has been proposed for continuously producing sugar, where the amounts of the sugar solution are retained equally in all the stages except the last stage, and the amounts of the sugar solution retained on all the stages except the last stage and the feed rates of the sugar solution to all the stages except the last stage are made substantially equal, respectively, in the continuous evaporator-crystallizer having a plurality of evaporating-crystallizing vessels as stages, each evaporating-crystallizing stage being communicated one to another in series and being provided with a means for feeding the sugar solution and a heating means, wherein the sugar solution is continuously fed to each stage and made to continuously transfer from an upper stage to a lower successive stage by overflow, water is evaporated and withdrawn continuously in each stage; the resulting sugar crystal slurry is continuously withdrawn from the last stage, while continuously adding seed sugar crystals to the first stage. In that case, a sugar crystal fraction must be adjusted to the desired value in the last stage, and thus the last stage is subject to somewhat different operation and takes a different stage structure from those of other stages. That is, the amount of the solution retained in the last stage must be changed from that of other stages. In said process, the following advantages can be obtained. That is, each stage including the heating means can have the same structure and its fabrication can be made simple by making the amounts of the solution to be retained in the stage equal throughout all the stages. By making the feed rate of the solution to every stages equal, sugar solution flow meters and steam flow meters of identical specifications can be used, and maintenance and operating control of the process can be also facilitated. In contrast to the process requiring for the increasing amounts of the solution retained and increasing feed rate of the solution in the latter stages, said process can use the increased feed rate of the solution to the first stage, reducing a change in the degree of supersaturation of the solution by disturbances, and the stable, continuous operation of the apparatus can be made very easily thereby. However, said process still has a disadvantage in obtaining sugar crystals of good quality, that is, crystal state of the product sugar, as will be described later in detail.

What is important in the production of sugar is that the product sugar must have a good quality, and especially the individual sugar crystals must have independent single crystals, and further that the crystals must grow only from the seed crystals.

When a sugar evaporator-crystallizer is misoperated, the so-called conglomerated grains, which are formed by mutual combination of crystals, are developed. Furthermore, the so-called false grains, which are spontaneously formed not from the seed crystals, are developed. These conglomerated grains and false grains degrade the product value of sugar. The occurrence of conglomerated grains is in a close relation to crystal distance between crystals, as defined below, and the conglomerated grains are formed when the crystal distance is too small. The occurrence of the false grains is in a close relation with the degree of supersaturation of the sugar solution, and the false grains are formed, when the degree of supersaturation is too high.

The crystal distance is defined by the following formula, assuming that crystal cubes are uniformly distributed in a cell:

$$S = (V/N)^{\frac{1}{3}} - d$$

*S:* crystal distance (mm)
*N:* number of crystals in cell
*d:* mean grain size of crystals (mm)
*V:* volume of cell ($mm^3$)

It is known in the batch process that conglomerated grains frequently occur when grain sizes of the crystals are small at the initial stage of boiling. As a result of repeated tests in a pilot plant, the present inventors have found the following fact in the continuous production of sugar. That is, it has been found that the occurrence of the conglomerated grains is quite considerable in the first stage, but very few in the second and succeeding stages, and further that, though there is a possibility to develop false grains throughout all the stages, the occurrence of false grains is most strongly influenced in the first stage where the grain sizes of the crystals are smaller. Thus, it is necessary in the production of sugar with a good quality to control the degree of supersaturation of the solution not too high throughout all the stages and appropriately control the crystal distance and the degree of supersaturation especially in the first stage.

According to the operating procedure for said evaporator-crystallizer having a plurality of stages of equal volumes, the sugar solution is fed to each stage at substantially equal feed rates except that to the last stage. However, in the pilot plant test, the sugar solution is fed to all the stages including the last stage at an equal feed rate for a convenience of comparison, using a sugar solution having a sugar concentration of 60% by weight and setting out the slurry to be withdrawn from the last stage to have the grain sizes of 0.45 mm and the crystal fraction of 45% by volume, where 36 g/h of sugar powders of average grain size of 10 $\mu$ is added to the first stage as seed crystals, and evaporation-crystallization is carried out under 80 mmHg adsolute. Feed rate, retention time, grain size and crystal distance thus obtained are given in Table 1.

Table 1

| Stage | Sugar solution feed rate (kg/h) | Retention time (h) | Grain size (mm) | Crystal distance (mm) |
|---|---|---|---|---|
| 1st | 100 | 0.808 | 0.182 | 0.199 |
| 2nd | 100 | 0.433 | 0.279 | 0.188 |
| 3rd | 100 | 0.308 | 0.348 | 0.173 |
| 4th | 100 | 0.244 | 0.404 | 0.142 |
| 5th | 100 | 0.207 | 0.450 | 0.138 |
| Total | 500 | 2.000 | — | — |

In the pilot plant test as given in Table 1, the crystal distance in the first stage is as small as about 0.2 mm, and a large amount of conglomerated grains are formed. Furthermore, a slight fluctuation in the feed rate of sugar solution to the first stage and evaporation rate gives an influence upon the degree of supersaturation, making it higher and developing false grains. That is, when the feed rates of the sugar solution are substantially equal in every stages, conglomerated grains and false grains are formed, and the product value of sugar is lowered thereby.

An object of the present invention is to overcome the disadvantages of the prior art and provide a process for continuously producing sugar of good quality with suppressed formation of the conglomerated grains and false grains.

That is, the present invention provides a process for continuously producing sugar from an aqueous sugar solution in a continuous sugar evaporator-crystallizer having a plurality of evaporating-crystallizing vessels as stages, each evaporating-crystallizing stage being communicated one to another in series an being provided with a means for feeding an aqueous sugar solution, a heating means and a means for withdrawing generated steam, by feeding and aqueous sugar solution to each evaporating-crystallizing stage, heating the aqueous sugar solution in each evaporating-crystallizing stage, thereby evaporating water off the solution, and crystallizing sugar crystals, and withdrawing the generated steam from each of the stages, while feeding seed sugar crystals to the first evaporating-crystallizing stage, and withdrawing the resulting sugar crystal slurry from the last evaporating-crystallizing stage, characterized by providing sugar crystal distances of 0.26 to 0.59 mm in the solution in the first evaporating-crystallizing stage.

The present invention furthermore provides the process characterized in that the aqueous sugar solution is fed to each of intermediate evaporating-crystallizing stages excluding the first and last evaporating-crystallizing stages at a substantially equal feed rate, and a feed rate of the aqueous sugar solution to the first evaporating-crystallizing stage is made at least 1.5 times the feed rate to each of the intermediate evaporating-crystallizing stages.

Now, the present invention will be described in detail, referring to the accompanying drawings.

Figure 1:
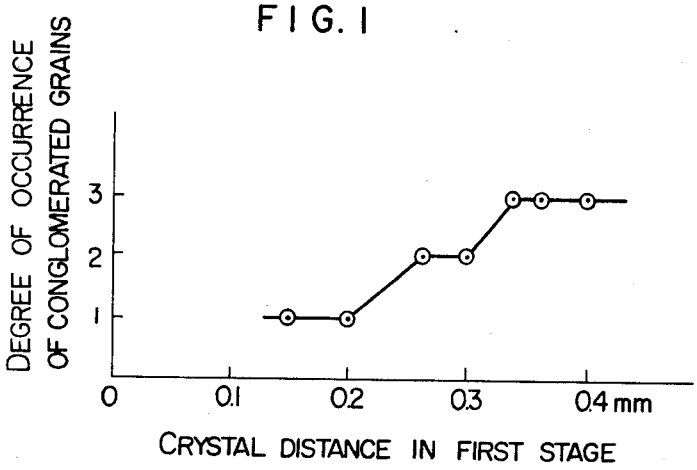
FIG. 1 is a graph showing a relation between crystal distance and degree of occurrence of conglomerated grains in the first stage.

In FIG. 1, pilot plant test data on a relation between various crystal distances in the first stage and degree of occurrence of conglomerated grains are shown, where the ratio of degree of occurrence of conglomerated grains is a comparison with the degree of the conventional batch process, that is, the degree of occurrence of conglomerated grains is a ratio of the degree of occurrence of conglomerated grains in the continuous production of sugar to the degree of occurrence of the commercially available product sugar produced by the conventional batch process. In other words, numeral 1 on the axis of ordinate shows more occurrences of conglomerated grains than that in the conventional batch process, numeral 2 an equal degree of occurrence to that in the conventional process, and numeral 3 less occurrence of conglomerated grains than that in the conventional batch process. That is, the numeral 1 indicates a poor quality as the product sugar, and numerals 2 and 3 a good quality as the product sugar.

Figure 2:
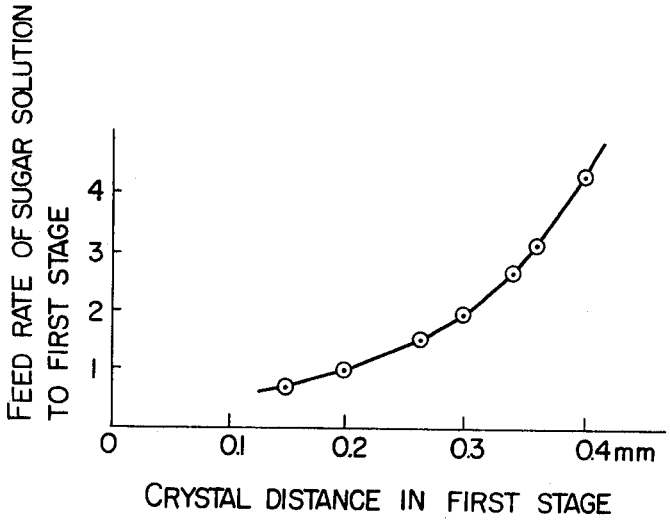
FIG. 2 is a graph showing a relation between crystal distance in the first stage and feed rate of sugar solution to the first stage.

In FIG. 2, a relation between the crystal distance in the first stage and the feed rate of the sugar solution to the first stage is given. When the stage of a sugar slurry to be withdrawn from the last stage is fixed, the feed rate of the solution to each stage is fixed to the crystal distance in each stage according to the law of conservation of mass on the sugar content. In FIG. 2, the grain size of crystals and the crystal fraction are set to 0.45 mm and 45% by volume, respectively, for the sugar crystal slurry to be withdrawn from the last stage, and a sugar solution having a sugar concentration of 60% by weight is fed to a continuous sugar evaporator-crystallizer having five stages. The feed rate of the sugar solution to the first stage on the axis of ordinate is a ratio of the feed rate to the first stage to that to each stage excluding the first stage. It is seen from FIG. 2 that, when the feed rate of the sugar solution is equal to one another except that the first stage, the crystal distance is increased with increasing feed rate of the sugar solution to the first stage. The crystal distance in the first stage for obtaining sugar of good quality is at least 0.26 mm from FIG. 1, and thus the feed rate of the sugar solution to the first stage must be at least 1.5 times the feed rate to each of the stages to provide the crystal the crystal distance of at least 0.26 mm in the solution in the first stage. When the feed rate to the first stage is further increased, the crystal distance is correspondingly increased, and the occurrence of the conglomerated grains can be effectively suppressed.

In Table 2, test data is given to confirm this effect, where test conditions are the same as given referring to Table 1 except the feed rate of the sugar solution to the stages.

Table 2

| Stage | Feed rate of sugar solution (kg/h) | Retention time (h) | Grain size (mm) | Crystal distance (mm) |
|---|---|---|---|---|
| 1st | 220 | 0.540 | 0.122 | 0.364 |
| 2nd | 70 | 0.440 | 0.221 | 0.299 |

Table 2-continued

| Stage | Feed rate of sugar solution (kg/h) | Retention time (h) | Grain size (mm) | Crystal distance (mm) |
|---|---|---|---|---|
| 3rd | 70 | 0.378 | 0.306 | 0.241 |
| 4th | 70 | 0.336 | 0.381 | 0.192 |
| 5th | 70 | 0.306 | 0.450 | 0.138 |
| Total | 500 | 2.000 | — | — |

The data given in Table 2 is compared with those given in Table 1. Table 1 shows the case where the feed rate of the sugar solution to each stage is equal to one another, and the crystal distance in the solution in the first stage is 0.20 mm, and it is confirmed that there is much occurrence of the conglomerated grains in the first stage. Table 2 shows the case where the feed rate of the sugar solution to be first stage is about three times that to each of other stages, and the crystal distance in the first stage is 0.36 mm, and it is confirmed that a very small amount of the conglomerated grains are formed, and the sugar crystals withdrawn from the last stage have a high quality and thus have a high product value.

However, there is an upper limit to the crystal distance in the first stage. As a mere operating procedure, the crystal distance in the first stage can be made infinite by increasing a proportion of the feed rate to the first stage, but the crystal distance in the first stage is restricted so as to obtain sugar of good quality. That is, when the sugar crystal slurry is withdrawn from the last stage, it is necessary as a prerequisite for the succeeding step of separation to maintain a crystal fraction of the slurry at least at 45% by volume or 50% by weight.

The prerequisite fixes the upper limit to the crystal distance in the first stage. That is, if the number of stages of a continuous evaporator-crystallizer is $n$, the feed rate of the solution to the first state $f_1$ (kg/h), the grain size of crystals in the first stage $d_l$ (mm), the total feed rate to the evaporator-crystallizer $f_o$ (kg/h), the grain size of the crystal in the last stage $d_n$ (mm), and the growth rate of the crystal $k$ (mm/h), it is necessary that the crystal distance $S_l$(mm) in the first stage satisfies the following equation.

$$S_1 = d_n\left\{\left(\frac{f_1}{kf_o}\right)^{1/3} - \frac{d_1}{d_n}\right\}$$

and $f_l$ can be set in a range of $0 < f_l \leqq f_o$. Thus, $d_l$ can be adjusted in a range of $d_n \geqq d_l > 0$. In view of $d_n = 0.45$ mm and $k \approx 0.225$ mm/h, $S_l \leqq 5.87$ is obtained from the equation. That is, the upper limit to the crystal distance in the first stage of 0.59 mm. To satisfy the required crystal fraction of the slurry from the last stage, it is necessary to keep the crystal distance not more than 0.59 mm in the first stage. When the crystal distance exceeds 0.59 mm, it is impossible to maintain the crystal fraction at least at 45% with the suppressed occurrence of the conglomerated grains and the false grains, whatever proportion the feed rate of the sugar solution to each stage may take.

Figure 3:
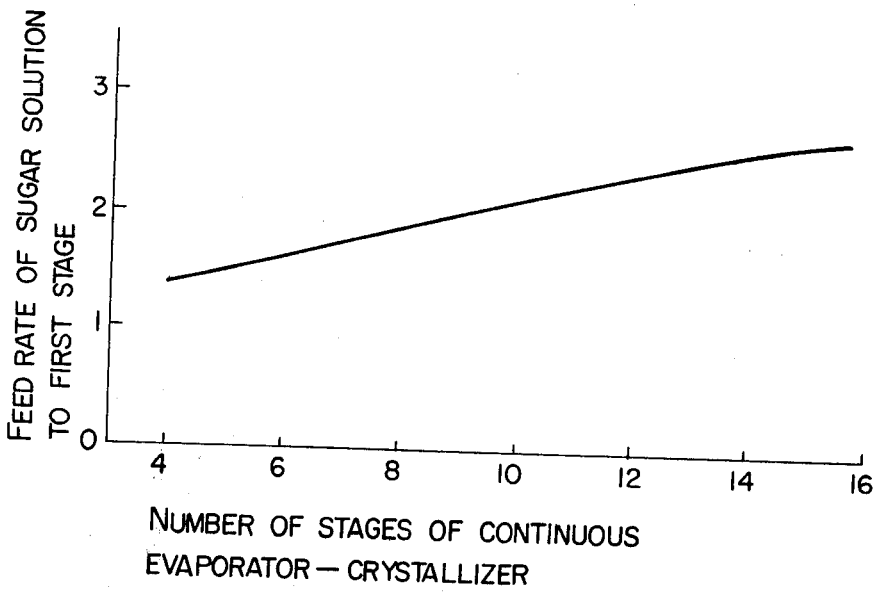
FIG. 3 is a graph showing a relation of number of stages of a continuous evaporator-crystallizer and feed rate of sugar solution to the first stage.

To keep the crystal distance in the solution in the first stage at least at 0.26 mm, it is necessary in the case of 5 stages ($n = 5$) that the feed rate of the sugar solution to the first stage is at least 1.5 times the feed rate to each of other stages. The general case of $n$ stages is shown in FIG. 3, where a relation between the number of stages and the feed rate of the sugar solution to the first stage is plotted under the conditions that the grain size of crystals and the crystal fraction are set to 0.45 mm and 45% by volume, respectively, for the sugar crystal slurry to be withdrawn from the last stage, and a sugar solution having a sugar concentration of 60% by weight is fed to a continuous sugar evaporator-crystallizer having *n* stages. The feed rate of the sugar solution to the first stage on the axis of ordinate is a ratio of the feed rate to the first stage to that to each stage excluding the first stage.

The number of stages in the continuous evaporator-crystallizer can be freely selected, but practically is 5 to 15. It is necessary that sugar of good quality consists of single crystals and has uniform grain sizes of crystals. The number of stage depends upon the grain size distribution of crystals, and at least 5 stages can give no practical problem. With increasing number of stages, sugar of more uniform grain sizes can be obtained, but more than 15 stages is not so effective, but merely complicates the apparatus, and renders a fabrication cost of the apparatus higher.

The feed rate of sugar solution to the first stage for providing an appropriate crystal distance of 0.26 to 0.59 mm therein is 1.5 for 5 stages, and 2.6 for 15 stages. That is, it is necessary that the feed rate of the sugar solution to the first stage is at least 1.5 times that to each of the intermediate stages excluding the first and last stages, preferably at least the ratio for each number of the stages shown in FIG. 3.

In the first stage, it is also necessary to suppress the occurrence of false grains due to an excessively high degree of supersaturation as well as the occurrence of conglomerated grains. The feed rate of sugar solution to the first stage is increased to suppress the occurrence of conglomerated grains, as described, above, and said increased feed rate also has a remarkable effect upon the suppression of false grains.

In the actual operation of a continuous evaporator-crystallizer, an amount of water to be evaporated is so set that the degree of supersaturation may not be too high. As disturbances there are small fluctuations $\Delta F$ and $\Delta E$ in the feed rate of sugar solution F and the amount of water to be evaporated E, respectively, and these fluctuations cannot be eliminated. The fluctuations in the feed rate of sugar solution and the amount of water to be evaporated give an influence upon the degree of supersaturation, causing the occurrence of false grains. The fluctuation $\Delta X$ in the degree of supersaturation (concentration) X is given by the following equation:

$$|\Delta X/X| = (X_o E/F)\{|\Delta F/F + \Delta E/E|\}$$

where $X_o$ is the concentration of sugar solution to be fed. In the actual process, the fluctuation appears as the phenomenon that the absolute value is constant, irrespectively of flow rate. In view of the fact that the feed rate F is considerably larger than the amount E of water to the evaporated, it is seen that the fluctuation $\Delta X/X$ in the degree of supersaturation can be kept smaller by increasing the feed rate F, and the disturbances are absorbed to suppress the occurrence of false grains.

In the test of Table 2, the fluctuation of the degree supersaturation is very small and almost negligible, as compared with the test of Table 1, and no occurrence of false grains is observed.

Figure 4:
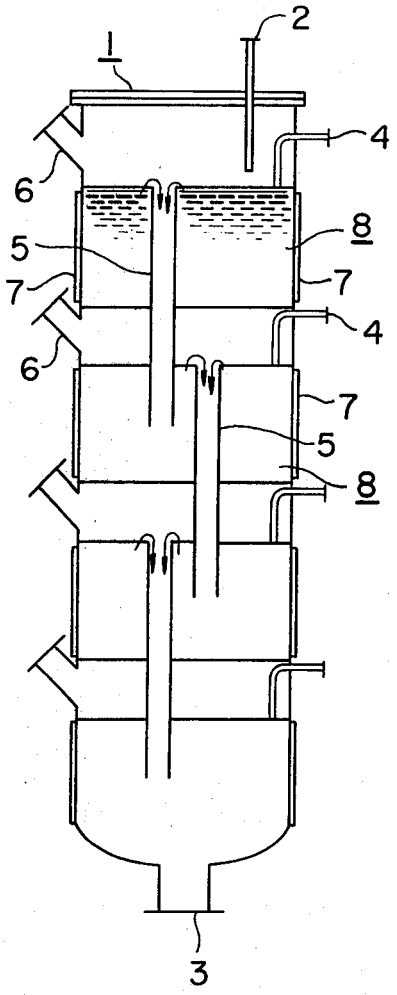
FIG. 4 is a vertical cross-sectional view of a continuous sugar evaporator-crystallizer showing a mode of carrying out the present invention.

A mode of carrying out the present invention will be described below, referring to FIG. 4, which shows a vertical cross-sectional view of a continuous sugar evaporator-crystallizer. In FIG. 4, a continuous sugar evaporator-crystallizer 1 having a seed crystal inlet 2 to the first stage at top and a slurry outlet 3 from the last stage at the bottom is comprised of a plurality of vessels 8 as stages, each of the stages being communicated one to another and provided with an inlet 4 for sugar solution, a solution passage 5, and evaporated water passage 6 and a heating element 7.

According to the structure of the evaporator-crystallizer as constructed as above, the sugar solution fed from the inlet 4 for sugar solution to the vessel 8 as the first stage is heated by the heating element 7 to evaporate water off the solution and concentrate the solution to a supersaturated state. Sugar is deposited onto the surfaces of the seed crystals fed from the seed crystal inlet 2. The sugar solution and crystals are led to the succeeding vessel as the next stage by overflow over the top end of the solution passage 5 after a definite retention time. The sugar solution are likewise successively tansferred to the lower vessels while repeating the evaporation and crystallization and allowing to make crystal growth set by the degree of supersaturation and the retention time. When the desired grain sizes of crystals are reached, the resulting slurry is withdrawn from the last stage through the slurry outlet 3. Product sugar is obtained after the successive steps of separation and drying. The water vapor generated in each stage is withdrawn to the outside through the individual evaporated water passage 6.

When the slurry containing sugar crystals is withdrawn from the last stage, it is necessary as the prerequisite for the succeeding step of separation to keep the crystal fraction of at least b 50% by weight in the slurry. Therefore, an operation to increase the crystal fraction in the last stage is required, and thus the feed rate of sugar solution to the last stage and the amount of water to be evaporated are sometimes made larger than those of the intermediate stages.

The present invention can produce sugar of good quality with suppressed occurrence of conglomerated grains and false grains by providing crystal distances of 0.26 to 0.59 mm in the solution in the first stage.

What is claimed is:

1. In a process for continuously producing sugar from an aqueous sugar solution in a continuous sugar evaporator-crystallizer having a plurality of evaporating-crystallizing vessels, each evaporating-crystallizing vessel being a stage, each stage communicated one to another in series and provided with a means for feeding an aqueous sugar solution, a heating means and a means for withdrawing generated steam, by feeding the aqueous sugar solution to each evaporating-crystallizing stage, heating the aqueous sugar solution in each evaporating-crystallizing stage, thereby evaporating water from the solution and crystallizing sugar crystals, and withdrawing the generated steam from each of the stages, while feeding sugar crystals to the first evaporating-crystallizing stage and withdrawing the resulting sugar crystal slurry from the last evaporating-crystallizing stage, the improvement which comprises providing a sugar crystal distance of 0.26 to 0.59 mm in the solution in the first evaporating-crystallizing stage.

2. In a process for continuously producing sugar from an aqueous sugar solution in a continuous evaporator-crystallizer having a plurality of evaporating-crystallizing vessels, each evaporating-crystalling vessel being a stage, each stage communicated one to another in series and provided with a means for feeding an aqueous sugar solution, a heating means and a means for withdrawing generated steam, by feeding the aqueous sugar solution to each evaporating-crystallizing stage, heating the aqueous sugar solution in each evaporating-crystallizing stage, thereby evaporating water from the solution and crystallizing sugar crystals, and withdrawing the generated steam from each of the stages, while feeding seed sugar crystals to the first evaporating-crystallizing stage and withdrawing the resulting sugar crystal slurry from the last evaporating-crystallizing stage, the improvement which comprises providing a sugar crystal distance 0.26 to 0.59 mm in the solution in the first evaporating-crystallizing stage, feeding the aqueous sugar solution to each of intermediate evaporating-crystallizing stages excluding the first and last evaporating-crystallizing stages at a substantially equal feed rate, and feeding the aqueous sugar solution to the first evaporating-crystallizing stage at a rate at least 1.5 times the feed rate to each of the intermediate evaporating-crystallizing stages.

3. A process according to claim 2, comprising providing sugar crystals having the sugar crystal distance of 0.26 to 0.59 mm represented by S in the equation $$S = (V/N)^{1/3} - d$$

where $N$ is a number of crystals in the cell, $d$ is the mean grain size of crystalls (mm) and $V$ is the volume of the cell ($mm^3$), by interrelatedly controlling the number of crystals in the cell, and the mean grain size of the crystals, with the cell having a fixed volume.

4. A process according to claim 2, wherein said seed sugar crystals have an average grain size of 10$\mu$ and are provided at a rate of 36 g/h.

5. A process according to claim 2, wherein the aqueous sugar solution fed to each evaporating-crystallizing stage has a sugar concentration of 60% by weight and wherein the sugar crystal slurry withdrawn from the last evaporating-crystallizing stage has a grain size of 0.45 mm and a crystal fraction of 45% by volume or 50% by weight.

6. A process according to claim 2, wherein the upper limit to the sugar crystal distance in the first stage of 0.59 mm is determined according to the equation $$S_1 = d_n\left\{\left(\frac{f_1}{kf_o}\right)^{1/3} - \frac{d_1}{d_n}\right\}$$

where $S_1$ is the sugar crystal distance, $n$ is the number of stages, $f_1$ (kg/h) is the feed rate of the solution to the first stage, $f_o$ (kg/h) is the total feed rate to the evaporator-crystallizer, $d_1$ (mm) is the grain size of crystals in the first stage, $d_n$ (mm) is the grain size of crystals in the last stage, $k$ (mm/h) is the crystal growth rate by controllably setting $f_1$ in a range of $0 < f_1 \leqq f_o$ and $d_1$ in a range of $d_n \leqq d_1 \geqq 0$, with $d_n$ fixed at about 0.45 mm and $k$ fixed at approximately 0.225 mm/h.

7. A process according to claim 2, wherein the number of evaporating-crystallizing stages is from 5 to 15 and wherein the feed rate of the aqueous solution to the first stage for providing the sugar crystal difference of 0.26 to 0.59 mm is dependent upon the number of stages determined according to FIG. 3.

* * * * *